US009340332B2

(12) United States Patent
Antal, Sr. et al.

(10) Patent No.: US 9,340,332 B2
(45) Date of Patent: May 17, 2016

(54) CLOSURE FOR CONTAINER

(71) Applicant: Sonoco Development, Inc., Hartsville, SC (US)

(72) Inventors: Keith E. Antal, Sr., Valatie, NY (US); Chad E. Lagace, Cohoes, NY (US); Terry Smith, Melbourne (AU)

(73) Assignee: Sonoco Development, Inc., Hartsville, SC (US)

( * ) Notice: Subject to any disclaimer, the term of this patent is extended or adjusted under 35 U.S.C. 154(b) by 44 days.

(21) Appl. No.: 13/836,982

(22) Filed: Mar. 15, 2013

(65) Prior Publication Data

US 2014/0263356 A1 Sep. 18, 2014

(51) Int. Cl.
*B65D 43/02* (2006.01)
*B65D 51/18* (2006.01)

(52) U.S. Cl.
CPC ..... *B65D 43/0256* (2013.01); *B65D 43/026* (2013.01); *B65D 43/0212* (2013.01); *B65D 51/18* (2013.01); *B65D 2101/0023* (2013.01); *B65D 2101/0069* (2013.01); *B65D 2543/0074* (2013.01); *B65D 2543/00092* (2013.01); *B65D 2543/00296* (2013.01); *B65D 2543/00509* (2013.01); *B65D 2543/00527* (2013.01); *B65D 2543/00537* (2013.01); *B65D 2543/00555* (2013.01); *B65D 2543/00629* (2013.01); *B65D 2543/00685* (2013.01);

(Continued)

(58) Field of Classification Search
CPC ..... B65D 2101/0069; B65D 2101/0023; B65D 43/0256
USPC ..... 220/784, 276, 284, DIG. 34; 215/901, 215/256, 253; 206/807
See application file for complete search history.

(56) References Cited

U.S. PATENT DOCUMENTS 3,380,610 A 4/1968 Krieps
3,381,872 A 5/1968 Holder et al.
3,407,957 A 10/1968 Robinson (Continued)

FOREIGN PATENT DOCUMENTS

CH 624356 A5 7/1981
DE 9109221 U1 9/1991

(Continued)

OTHER PUBLICATIONS

International Search Report and Written Opinion for PCT/US2014/024186 (Date of Search May 15, 2014).

*Primary Examiner* — Jeffrey Allen
*Assistant Examiner* — Jennifer Castriotta
(74) *Attorney, Agent, or Firm* — Flaster/Greenberg P.C.

(57) ABSTRACT

A closure is provided for use in covering an opening in a container and engaging a peripheral rim defining the opening. The closure includes a body for covering the container opening and a plurality of projecting portions that extend from a periphery of the body. The projecting portions are spaced from one another around the periphery of the body, with each formed to surround a portion of the container rim. A ring is connected to the projecting portions and surrounds the container rim. A plurality of retaining fingers are provided, with each fingers spaced from one another and interleaved within the spacing between adjacent projecting portions. The fingers project inwardly from the ring and include a projected end for engagement with the container rim. The projected ends of the fingers include a varied or undulating surface.

9 Claims, 13 Drawing Sheets

(52) U.S. Cl.
CPC ..... *B65D 2543/00759* (2013.01); *B65D 2543/00805* (2013.01); *B65D 2543/00814* (2013.01)

(56) References Cited

U.S. PATENT DOCUMENTS

| | | | | | |
|---|---|---|---|---|---|
| 3,532,244 | A | | 10/1970 | Yates, Jr. | |
| 3,753,511 | A | | 8/1973 | Ruch | |
| 3,770,156 | A | | 11/1973 | Yates, Jr. | |
| 3,773,207 | A | | 11/1973 | Dokoupil et al. | |
| 3,837,518 | A | | 9/1974 | Gach | |
| 3,866,784 | A | | 2/1975 | Beck | |
| 3,979,003 | A | | 9/1976 | Allen | |
| 4,111,329 | A | | 9/1978 | Lampman | |
| D251,828 | S | | 5/1979 | Smith | |
| 4,177,930 | A | | 12/1979 | Crisci | |
| 4,190,175 | A | | 2/1980 | Allen | |
| 4,281,774 | A | | 8/1981 | Mumford | |
| 4,305,517 | A | | 12/1981 | Dennis | |
| 4,458,821 | A | * | 7/1984 | Ostrowsky | 215/252 |
| 4,493,432 | A | | 1/1985 | Smith | |
| 4,602,718 | A | | 7/1986 | Dutt | |
| 4,607,759 | A | * | 8/1986 | Boetzkes | 220/266 |
| 4,625,876 | A | * | 12/1986 | Bullock, III | 215/256 |
| 4,625,890 | A | | 12/1986 | Galer | |
| 4,660,735 | A | | 4/1987 | Peschardt et al. | |
| 4,682,706 | A | | 7/1987 | DeVore et al. | |
| D292,380 | S | | 10/1987 | Smith | |
| 4,711,364 | A | | 12/1987 | Letica | |
| 4,718,571 | A | | 1/1988 | Bordner | |
| 4,730,745 | A | | 3/1988 | Perry | |
| 4,768,668 | A | | 9/1988 | Van Den Brink | |
| 4,771,905 | A | | 9/1988 | Perne et al. | |
| 4,779,750 | A | | 10/1988 | Armstrong | |
| 4,787,530 | A | | 11/1988 | Edwards | |
| 4,798,301 | A | | 1/1989 | Bullock et al. | |
| 4,815,620 | A | | 3/1989 | Bullock, III | |
| 4,826,039 | A | | 5/1989 | Landis | |
| 4,934,554 | A | | 6/1990 | Edwards | |
| 5,002,198 | A | | 3/1991 | Smith | |
| 5,065,883 | A | * | 11/1991 | Udell | 220/276 |
| 5,115,934 | A | | 5/1992 | Nelson | |
| D339,525 | S | | 9/1993 | Morris, Sr. | |
| 5,258,191 | A | | 11/1993 | Hayes | |
| 5,271,517 | A | | 12/1993 | Bowers | |
| 5,294,015 | A | | 3/1994 | Landis | |
| 5,377,861 | A | | 1/1995 | Landis | |
| 5,443,853 | A | | 8/1995 | Hayes | |
| 5,465,858 | A | * | 11/1995 | Gargione | 215/252 |
| 5,538,154 | A | | 7/1996 | Von Holdt | |
| 5,540,342 | A | | 7/1996 | Rathbun | |
| 5,588,562 | A | * | 12/1996 | Sander et al. | 222/153.06 |
| 5,617,968 | A | | 4/1997 | Luburic | |
| 5,711,443 | A | | 1/1998 | Bennett | |
| D394,184 | S | | 5/1998 | Demore | |
| 5,862,932 | A | | 1/1999 | Walsh et al. | |
| 5,873,484 | A | | 2/1999 | Clute et al. | |
| 5,901,870 | A | | 5/1999 | Wagner | |
| 6,000,570 | A | | 12/1999 | Nelson | |
| 6,102,225 | A | | 8/2000 | Lynn | |
| 6,193,921 | B1 | | 2/2001 | Nelson | |
| 6,220,471 | B1 | | 4/2001 | Lowry | |
| 6,260,723 | B1 | | 7/2001 | Bergholtz | |
| 6,279,774 | B1 | | 8/2001 | Clute et al. | |
| 6,478,183 | B1 | | 11/2002 | Bacon et al. | |
| 6,543,635 | B2 | | 4/2003 | Ciccone | |
| D477,968 | S | | 8/2003 | Bin | |
| D481,312 | S | | 10/2003 | Martin et al. | |
| 6,779,676 | B2 | | 8/2004 | Ciccone | |
| 6,899,245 | B1 | | 5/2005 | Nelson | |
| D506,359 | S | | 6/2005 | Zettle et al. | |
| D508,188 | S | | 8/2005 | Zettle et al. | |
| 6,942,114 | B2 | * | 9/2005 | Nishida | 215/252 |
| 6,959,829 | B2 | | 11/2005 | Crider et al. | |
| D519,374 | S | | 4/2006 | Hornke | |
| D521,382 | S | | 5/2006 | Gross et al. | |
| D533,778 | S | | 12/2006 | Hollis et al. | |
| 7,207,457 | B2 | | 4/2007 | Schwarz | |
| D544,301 | S | | 6/2007 | Tien | |
| D545,618 | S | | 7/2007 | Zettle et al. | |
| D549,522 | S | | 8/2007 | Tien | |
| D550,035 | S | | 9/2007 | Tien | |
| D556,573 | S | | 12/2007 | Hollis et al. | |
| D556,574 | S | | 12/2007 | Hollis et al. | |
| 7,311,218 | B2 | | 12/2007 | Varadarajan | |
| 7,703,626 | B2 | | 4/2010 | Witt | |
| 7,896,185 | B2 | | 3/2011 | Campbell et al. | |
| 7,909,204 | B2 | | 3/2011 | Antal, Sr. | |
| 7,918,360 | B2 | | 4/2011 | Mengeu et al. | |
| 7,963,419 | B2 | | 6/2011 | Burney et al. | |
| D642,467 | S | | 8/2011 | Knutson et al. | |
| D645,741 | S | | 9/2011 | Dunwoody | |
| D649,403 | S | | 11/2011 | Eyal | |
| D650,275 | S | | 12/2011 | Dunwoody | |
| D650,669 | S | | 12/2011 | Dunwoody | |
| D650,670 | S | | 12/2011 | Dunwoody | |
| D651,081 | S | | 12/2011 | Dunwoody | |
| D651,082 | S | | 12/2011 | Dunwoody | |
| D651,853 | S | | 1/2012 | Eyal | |
| D652,297 | S | | 1/2012 | Dunwoody | |
| 8,181,819 | B2 | | 5/2012 | Burney et al. | |
| D662,361 | S | | 6/2012 | Eyal | |
| D684,813 | S | | 6/2013 | Eyal | |
| 2004/0045966 | A1 | | 3/2004 | Von Holdt, Jr. | |
| 2006/0273091 | A1 | | 12/2006 | Hornke et al. | |
| 2009/0090712 | A1 | | 4/2009 | Vovan | |
| 2009/0173656 | A1 | | 7/2009 | Furlong | |
| 2009/0289074 | A1 | | 11/2009 | McNamara | |
| 2010/0181314 | A1 | | 7/2010 | Renda et al. | |
| 2011/0068079 | A1 | | 3/2011 | Luzatto et al. | |

FOREIGN PATENT DOCUMENTS

| | | | |
|---|---|---|---|
| EP | 121201 | A1 | 10/1984 |
| EP | 1160171 | A2 | 12/2001 |
| FR | 2801373 | A1 | 6/2001 |
| GB | 201899 | A | 3/1924 |
| WO | 2004013011 | A1 | 2/2004 |
| WO | 2012094801 | A1 | 7/2012 |

* cited by examiner

CLOSURE FOR CONTAINER

FIELD OF THE INVENTION

The present disclosure relates to an overcap, lid or closure structure for use along with a container to form a package. The closure is formed for sealing a container discharge. Preferably, the closure includes structures providing tamper evidence.

BACKGROUND OF THE INVENTION

Containers have been used for a variety of products, including food products, cleaning products, etc. Containers may be constructed of any number of materials. One container example includes a composite body portion, an open top end and a lip or rim, with the material rolled to form a projecting bead adjacent an external sidewall. A closure, lid or overcap may further be provided for closing the container opening. In an alternative example, the container rim may include an end ring, fixed to the container body and forming the retaining bead.

Container closures typically fit over the container top end or opening. The closure may also cover a discharge valve formed on the container. The closure serves many functions including, but not limited to, protecting the discharge of the container from damage, preventing or deterring unwanted access into the container, maintaining the product within the container and preventing spilling, helping to improve stacking of multiple containers, and increasing the useful life of the product after opening.

Overcaps may also be provided with means for deterring tampering with the container contents prior to use by a consumer and/or may be provided with related or separate means for indicating that tampering may have occurred.

U.S. Pat. No. 5,538,154 to Von Holdt shows a snap-on, flexible lid having spaced panel portions on the sidewall flange of the lid having inwardly projecting structures that are positioned to engage the bead of the container rim. Vertically aligned tear lines are provide on the side edges of the panel portions for separation of the panels from the remainder of the lid flange for ease of flexing the panel portions away from engagement with the container bead.

U.S. Pat. No. 4,934,554 to Edwards shows a tamper evident lid structure having an outer ring attached to the sidewall flange of the lid. The tamper evident portions are provided at various locations within an inverted u-shaped channel. The ring is provided with a hook member and includes a barb for retention on the bead of the container rim. An opening in the sidewall is provided at the location of the hook member. The ring may be removable by a tearing action, which also removes the hook members.

U.S. Pat. No. 7,918,360 to Mengeu et al. shows a container and overcap combination for a microwavable container, wherein the overcap includes a skirt portion having at least one flexible member therein for releasable engagement with a bead on the rim of the container. The members may be flexed outwardly to release engagement with a bead on the container. An opening is provided in the top of the skirt portion, adjacent each member, providing access to the flexible member.

U.S. Pat. No. 6,899,245 to Nelson shows a tamper resistant container lid having a band surrounding the container bead engagement structures. The band forms a tear strip and is separated into a plurality of spaced tabs having spurs formed on the inside, inwardly directed surfaces. Removal of the band separates the spurs and exposes a bead engagement structure on the lid.

U.S. Pat. No. 4,281,774 to Mumford shows a tamper evident snap-on cap having an outer skirt for engagement of a beaded rim on a container and an integral tear strip for tamper evidence. An inwardly positioned annular wall forms a plug for engagement with the interior surface of the container rim.

SUMMARY OF THE INVENTION

In one aspect of the disclosure, a closure is defined for use in covering a container discharge. The discharge is defined by a peripheral rim having an external sidewall and an outwardly projecting bead. The closure includes a body portion adapted to cover the discharge and a plurality of projecting portions extending from a periphery of the body. The projecting portions are spaced from one another around the body, with each adapted to engage a portion of the container rim and a corresponding portion of the bead. A ring is connected to the projecting portions and is adapted to surround the rim in a spaced relationship. A plurality of spaced retaining fingers is provided, with the fingers interleaved within the spacing between adjacent projecting portions. The fingers project inwardly from the ring and each include a projected end. The projected end of the fingers defines an undulating surface adapted to engage the bead associated with the container rim. The engagement of the fingers with the bead is visible through the spacing between the projecting portions. In addition, the fingers are removed along with the ring upon a frangible disconnection of the ring.

In a further aspect of the closure, the projecting portions may include an inwardly facing surface having an inwardly projecting ridge thereon for engaging the bead portion of the container rim. The projecting portions may be formed as curved portions for wrapping around the container rim.

In a further aspect of the closure, the body portion may include a substantially planer surface that overlaps with at least a portion of the container rim. The body may include a well formed by a base surface and a projecting sidewall. The projecting sidewall may be formed for engagement with an internal sidewall of a discharge opening in the container. A peripheral flange may be provided around the internal sidewall, with the projecting portions extending from the flange.

In a further aspect of the closure, the undulating surface on the projected ends of the fingers may include a plurality of transverse ridges. Alternatively or in addition thereto, the undulating surface may be formed by a series of planer sections having a varied projection length. The projected sections may include a separation there between, so that the sections are independently flexible.

In a further aspect of the closure, the body portion may define a projecting dome, with the projecting portions extending from a base of the dome. The ring may be frangibly connected to the projections at the base of the dome.

In another aspect of the present disclosure, a package is provided including a container and a closure. The container includes a rim surrounding a container discharge. A closure removably covers the container discharge and engages the peripheral rim on the container. The closure includes a body portion dimensioned to cover the container discharge and a rim engagement structure formed by a plurality of projecting portions. The projecting portions are each formed to engage the rim and to removably retain the closure in a covering relation with the discharge. A ring is frangibly affixed to projecting portions and adapted to substantially encircle the rim of the container. A plurality of tamper-evident fingers project from an inside surface of the ring, with each finger angled inwardly and having a projected end adapted for engagement with the container rim. The fingers are spaced from one another and positioned within the spacing defined by the projecting portions. The engagement of the container rim by the fingers is visible through the spacing to form a tamper-evident assembly. The projected end of the fingers defines an undulating surface.

In a further aspect of the package, the undulating surface of the projected ends of the fingers may include a plurality of transverse ridges. Alternatively or in addition thereto, the undulating surface is formed by a series of planer sections having a varied projection length. The planer sections may further be separated so as to be independently flexible.

In a further aspect of the package, the container discharge may be an opening defined by the rim, with the opening defining access to an interior volume of the container. Alternatively, the discharge may be a valve structure projecting from the container and surrounded by the rim. The body of the closure may be defined as a projecting dome, with the projecting portions extending from a base of the dome.

Other features of the present invention and combinations of features will become apparent from the detailed description to follow, taken in conjunction with the accompanying drawings.

BRIEF DESCRIPTION OF THE DRAWINGS

For the purpose of illustrating the invention, the drawings show one or more forms that are presently preferred. It should be understood that the invention is not limited to the precise arrangements and instrumentalities shown in the drawings.

DETAILED DESCRIPTION

Figure 1:
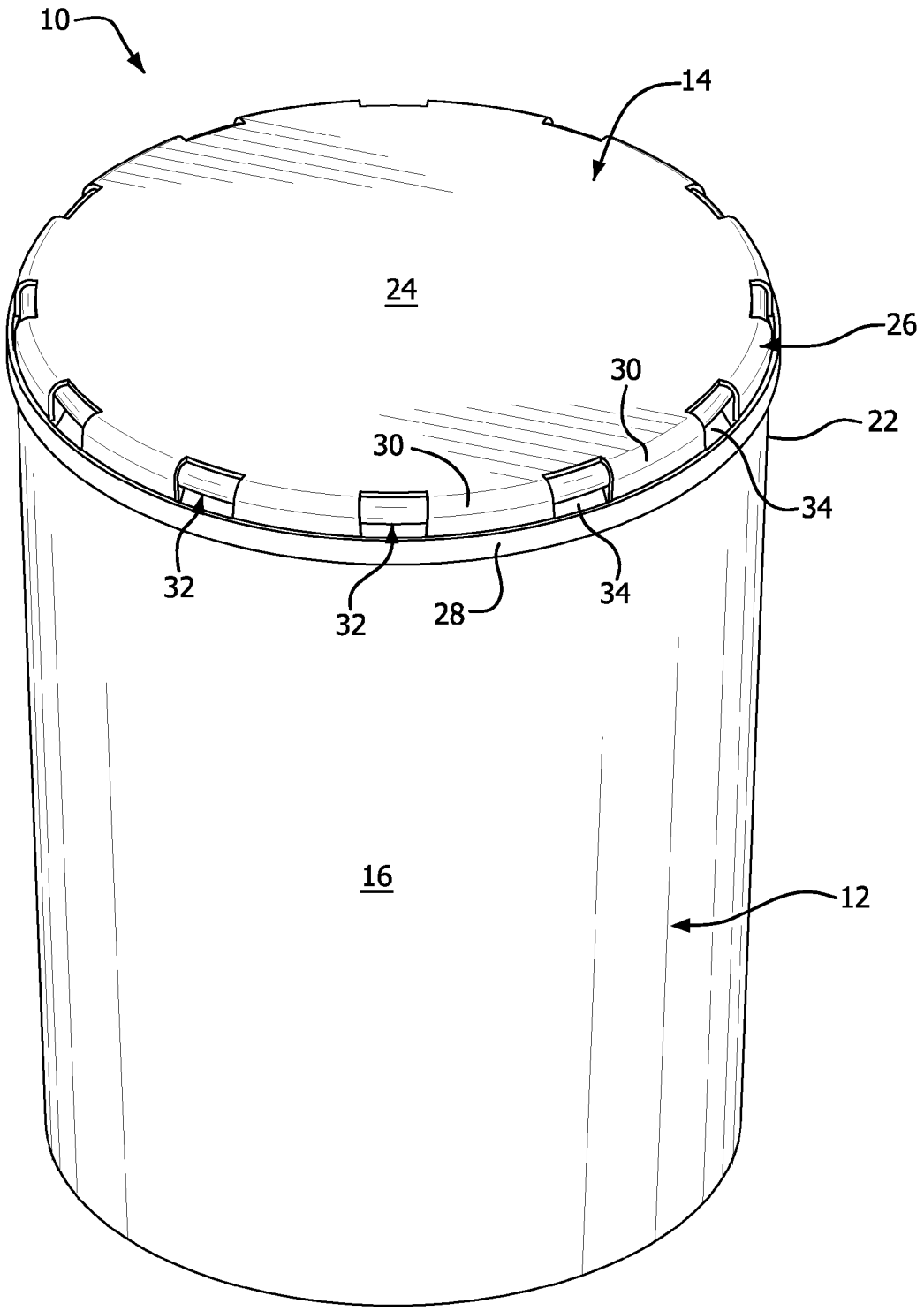
FIG. 1 shows an isometric view of a package in a form contemplated by the present disclosure, the package including a container and a closure.
Figure 1A:
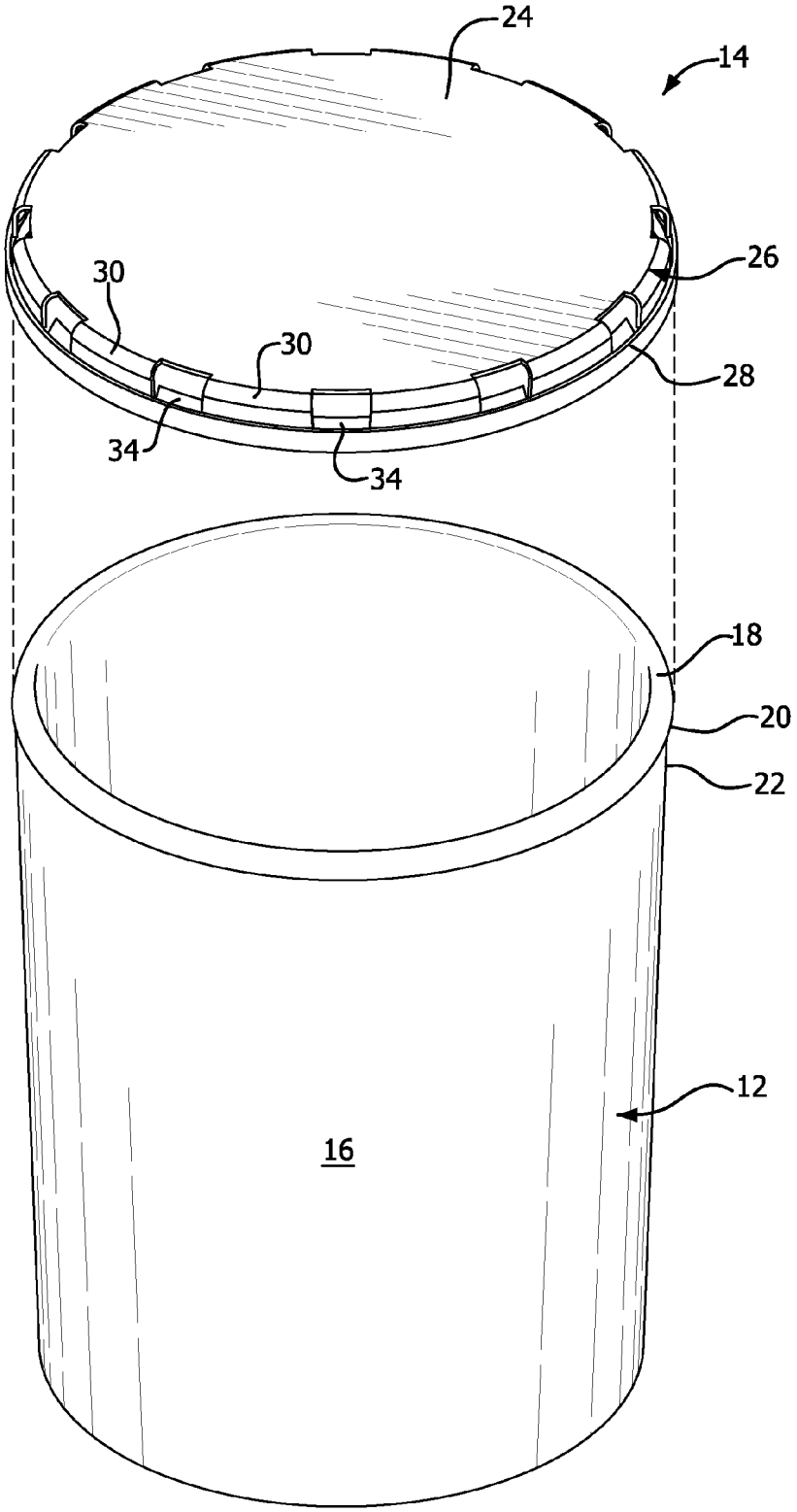
FIG. 1A shows an isometric view of a package as shown in FIG. 1, wherein the closure is separated from the container.
Figure 2:
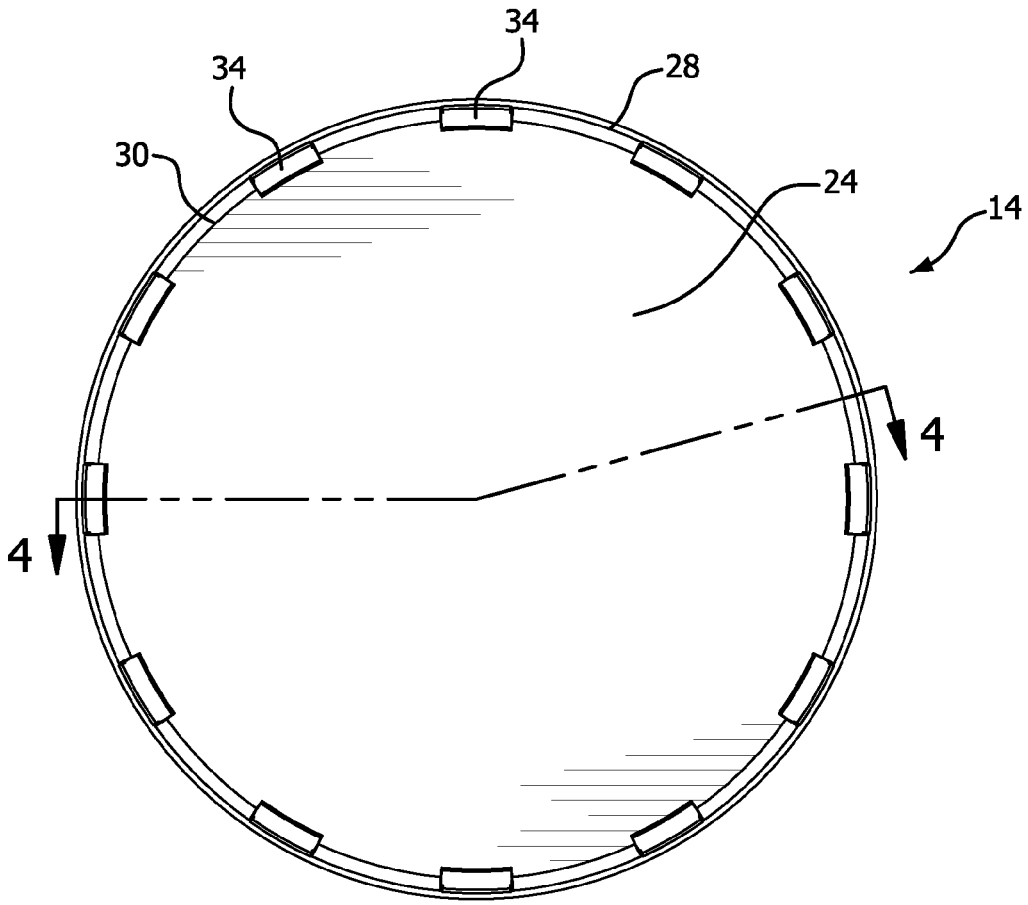
FIG. 2 shows a top plan view of the closure embodiment shown in FIG. 1.

In the figures, where like numerals identify like elements, there is shown an embodiment of a package formed by a combination of a container and overcap, lid or closure. In FIGS. 1 and 1A, the package is generally designated by the numeral 10, the container by the numeral 12 and the closure by the numeral 14. The container 12 includes a sidewall 16 that, along with the bottom wall (not shown), defines an internal storage volume for a product or the like. A discharge opening is provided at the upper end of the sidewall 16. The discharge opening is defined by an annular rim 18, which is shown to include an outwardly projecting bead 20. An external surface 22 of the sidewall 16 is formed below the bead 20. The closure 14 is secured to the rim 18 of the container 12 and covers the opening.

The closure 14 includes a central body portion 24 and a surrounding skirt 26. The skirt includes an annular ring portion 28 at its base. The body 24 is preferably dimensioned to extend across and cover the discharge opening (see FIG. 1A) at the top end of the container 12. The skirt portion 26 extends outwardly from the body 24 and surrounds the container rim 18. The skirt 26 includes a plurality of projections 30 that—as shown—curve away from the body 24 and wrap around at least a portion of the rim 18. The projections 30 are spaced from one another. The ring 28 is frangibly connected to the ends of the projections 30. The ring 28 surrounds the rim 18, when the package 10 is assembled, and is spaced from the rim 18. A plurality of inwardly directed fingers or tabs 34 are provided on the ring 28. The fingers 34 angle upwardly and inwardly from the inside of the ring 28.

Figure 3:
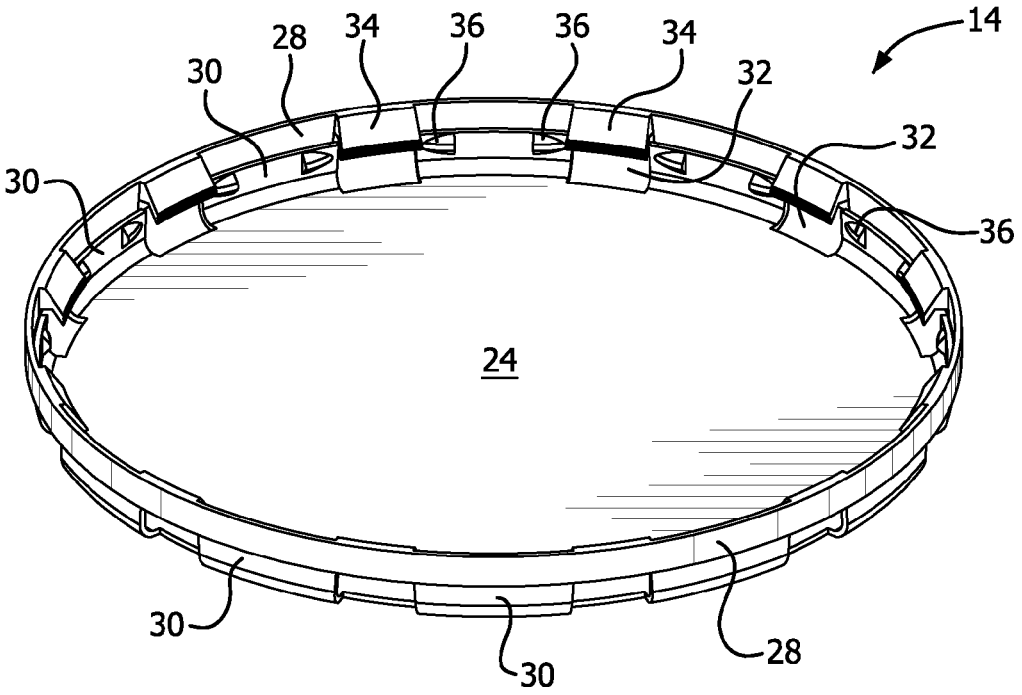
FIG. 3 shows a bottom isometric view of the closure embodiment of FIGS. 1-2.

Further specifics of the overcap or closure 14 are shown in detail within FIGS. 2-6. In the top view of FIG. 2, the spaces 32 between the projections 30 are shown to provide a view of the fingers 34. In FIG. 3, the internal structure of the closure is shown. The spaces 32 define visual access to the fingers 34, which project inwardly towards the body 24 of the closure 14. The fingers 32 are interleaved with the projections 30. The inside surfaces of the projections 30 are provided with a plurality of ridge elements 36. The ridges 36 are provided for releasable engagement with the rim 18 of the container 12.

Figure 4:
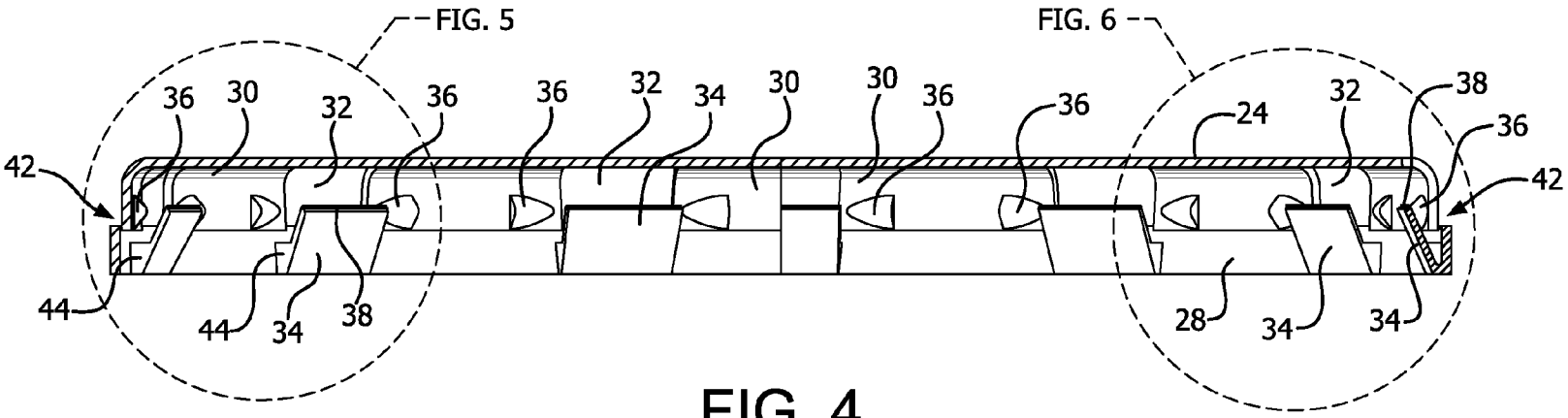
FIG. 4 shows a cross sectional view of the closure as taken along line 4-4 in FIG. 2.
Figure 6:
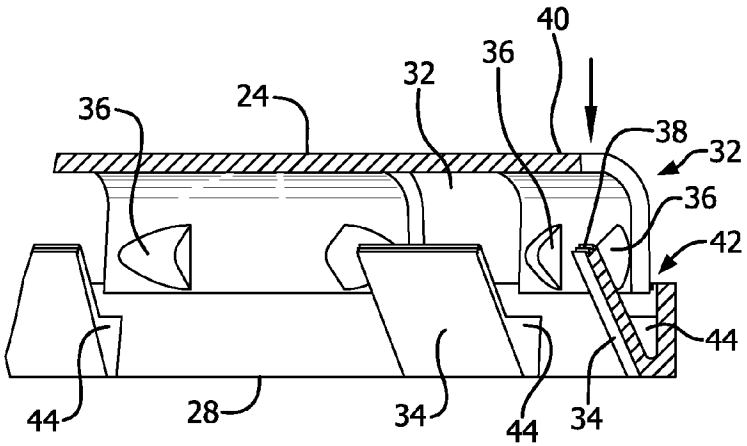
FIG. 6 shows a close-up view of another portion of the closure taken from FIG. 4.
Figure 5:
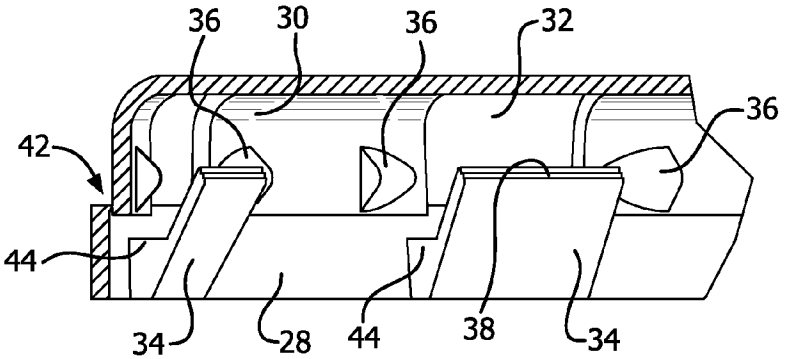
FIG. 5 shows a close-up view of a portion of the closure taken from FIG. 4.

As shown in FIGS. 4-6, the fingers 34 are aligned with the spaces 32 and interleaved between adjacent projections 30. The fingers 34 angle inwardly from the ring 28. The ring 28 is preferably frangibly attached to the projections 30, so that the ring 28 may be separated from the skirt 26. Separation of the ring 28, serves to disconnect the fingers 34 from the body 24 of the closure 14. The ridges 36 on the projections 30 are substantially aligned with the projected ends 38 of the fingers 34. Upon separation of the ring 28 and the fingers 34, the ridges 36 will engage under the bead 18 of the container rim to (releasably) retain the closure on the container 12.

As shown in FIG. 6, the projected end 38 of the finger 34 is vertically aligned with the outer edge 40 of the closure body 24, such that vertical access (see arrow) to the finger 34 is provided through the opening 32. The vertical access in the formation permits the molding of the overcap by the use of two fixed mold halves, which separate from above and below the closure body to release the part from the mold. The ridges 36 project inwardly from the inside wall of the projections 30 and are limited in inward extension. By controlling the dimensions and mold times, removal of the mold halves is permitted without significant deformation of the ridges 36 as the part is removed from the mold.

Figure 6A:
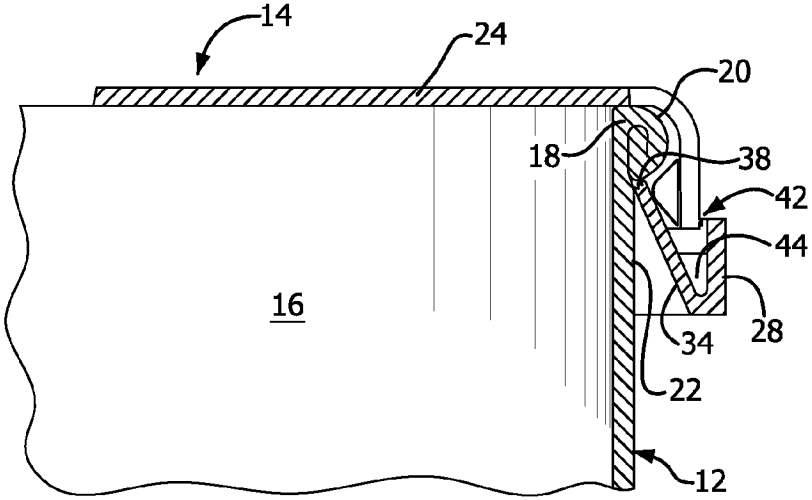
FIG. 6A shows an alternate view of the closure portion of FIG. 6, with the container shown in an engaged position.
Figure 5A:
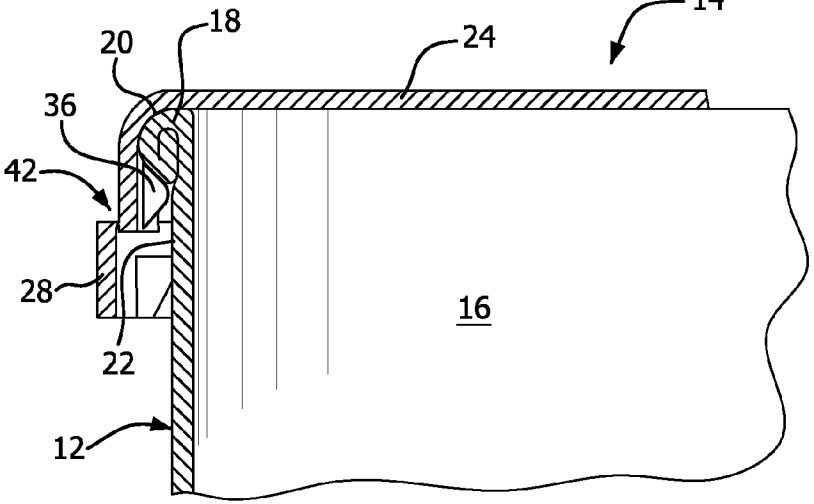
FIG. 5A shows an alternate view of the closure portion of FIG. 5, with the container shown in an engaged position.

In FIGS. 5A and 6A, there is shown the engagement of the closure 14 with the rim 18 of the container 12. The central body 24 covers the discharge opening defined by the rim 18. The ridges 36 and the inwardly angled fingers 34 engage the outwardly projecting bead 20. In FIG. 5A, the cross section is taken through a projection 30, which wraps around the rim 18 of the container 12. The ring 28 surrounds the rim 18 and is spaced from the bead 20 and the upper sidewall 22 of the container 12. One of the ridges 36 is shown on the inside surface of the projection 30 and is positioned on the underside of the bead 20. Once the ring 28 is removed, by separation along the frangible connection 42, the ridges 36 serve as a means to releasably retain the closure 14 on the container 12. In FIG. 6A, the cross section is taken through a finger 34, which is aligned within a space 32 between the adjacent projections 30. The projected end 38 of the finger 34 engages underneath the rim 18 at the junction of the bead 20 and the upper sidewall 22. Before removal of the ring 28, the fingers 34 serve as a tamper resistant structure, for maintaining the package 10 sealed during shipment, during storage and at the point of sale.

As shown in FIGS. 5 and 6, the projected end 38 of each finger 34 includes an undulating or non-uniform surface, having a number of transverse ridges. The undulating surface of the projected ends 38 provides an engagement surface for the fingers 34 with the bead 20 of the container rim 18. The engagement of the projected ends 38 of the fingers 34 is contemplated to hold the closure 14 in place. The undulating surface on the projected end 38 of the fingers 34 assists in the engagement between the fingers 34 and the bead 20 by increasing the frictional contact and resisting transverse movement along the underside of the bead 20. The flexibility of the ridges on the projected end 38 of the finger 34 may be controlled by varying the material, the thickness of the finger 34 or the length of each ridge in the undulating surface. The fingers 34 are also connected to the inner surface of the ring 28 by ribs 44. The ribs 44 serve to increase the stiffness of the fingers 34 by limiting flex between the fingers 34 and the ring 28. The height of the ribs 44 may further serve to control the engagement between the projected end 38 of the fingers 34 and the bead 20 on the container rim 18. The ribs 44 may also assist in providing a visual identification of tampering. The ribs 44 in essence make it more difficult for the fingers 34 to be deformed. Hence, any bending of the fingers 34 away from the rim 18 or the engagement of the bead 20 preferably results in a plastic deformation of the material forming the finger 34 and/or the connecting rib 44, which would be visible upon inspection through the spaces 32 between adjacent projections.

Figure 7:
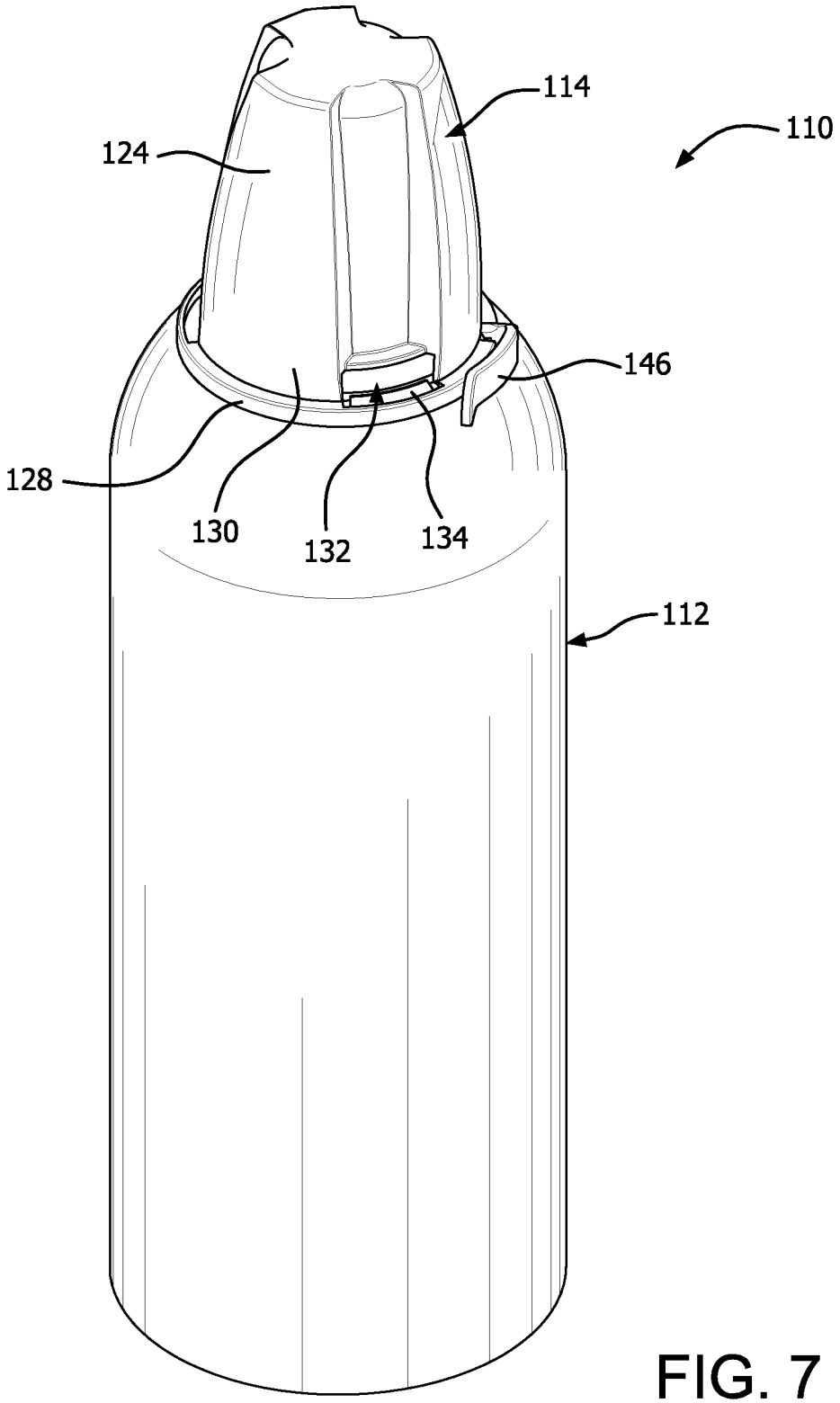
FIG. 7 shows an isometric view of a further package form, the package including an alternate form of a container and a closure.

In FIG. 7, there is shown a package 110 formed from a container 112 and a closure 114. The container 112 is shown as a canister for housing a compressed fluid and for discharging the fluid as an atomized spray, foam or similar form. The closure 114 is shown as having a dome shaped body 124 with a surrounding frangible ring 128. A tab 146 projects from the ring 128 and creates a gripping surface for starting disconnection of the ring 128 from the body 124 of the closure. A discharge valve (not shown) is contemplated to project from the upper end of the container 112 and is protected by the dome of the closure body 124.

Figure 8:
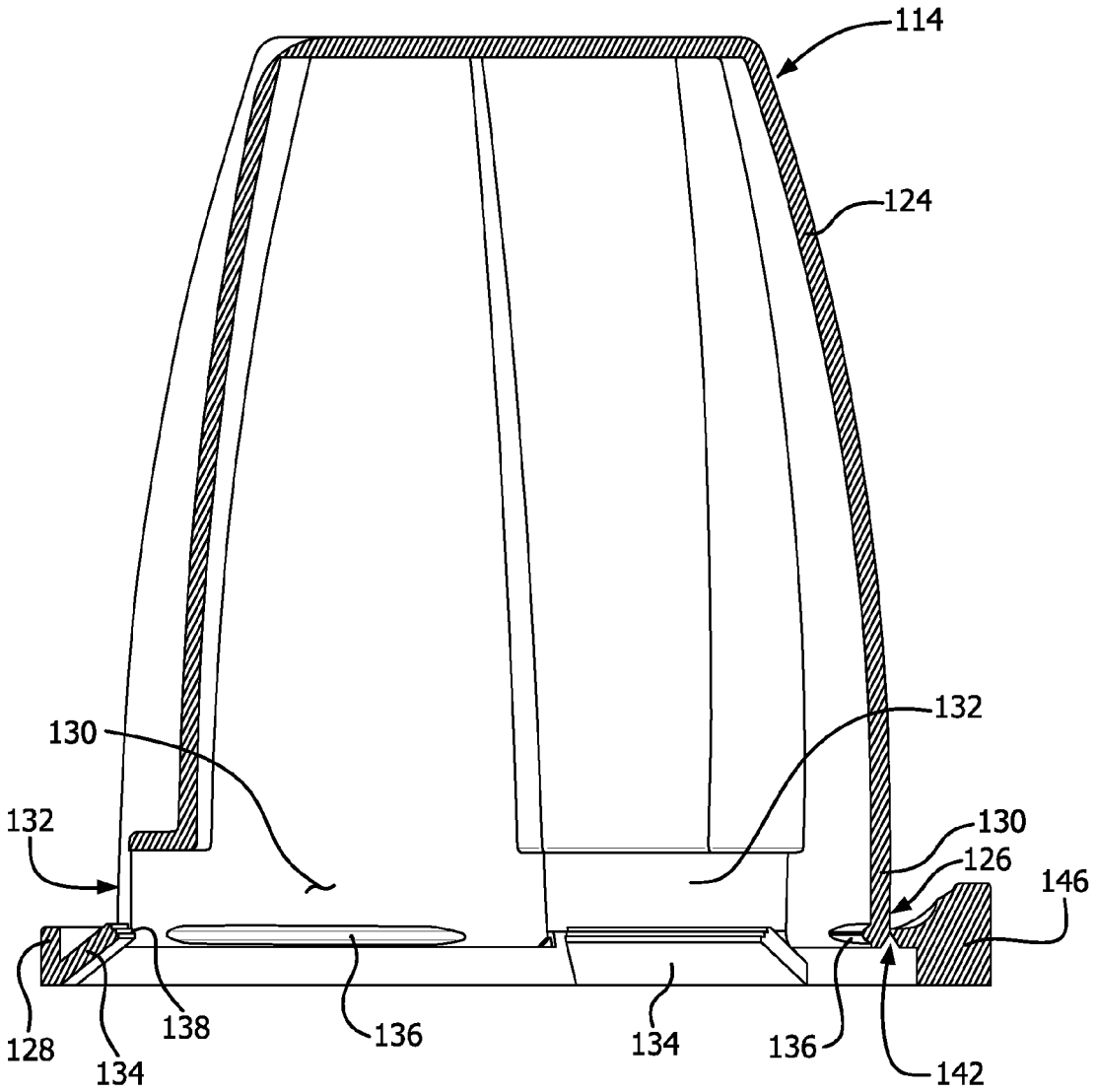
FIG. 8 shows a cross sectional view of the closure form shown in FIG. 7.
Figure 9:
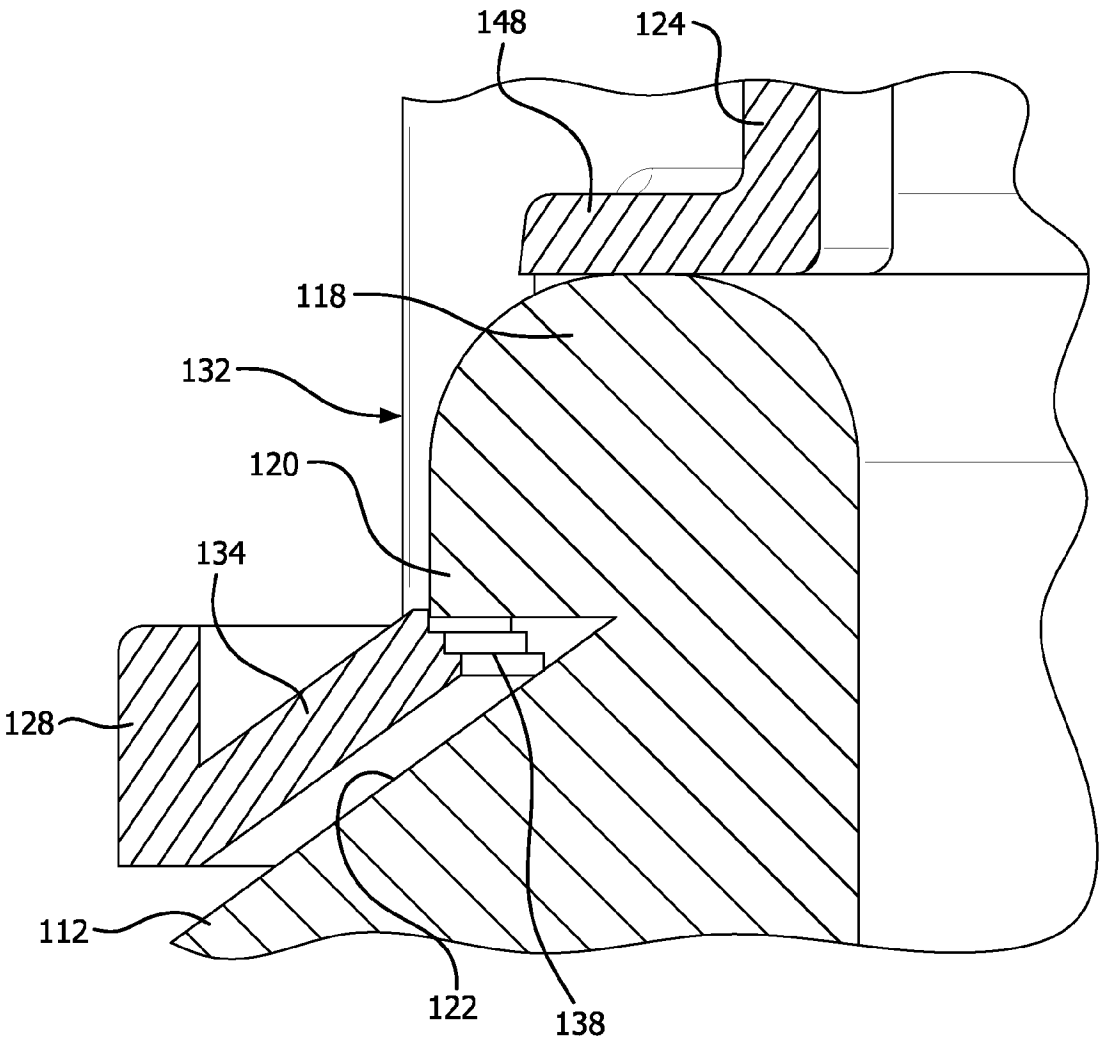
FIG. 9 shows a close-up cross sectional view of a portion of the closure of FIGS. 7 and 8, with the closure in engagement with a rim on the container.

The closure 114 is shown in cross section in FIG. 8. The dome of the body 124 forms a central volume for receiving a projecting valve (not shown) on the container (112). A plurality of spaced fingers 134 project from the inside surface of the ring 128 formed at the base of the body 124. A series of openings 132 are formed in the base of the body 124 and are aligned with the fingers 134. Defining the openings 132 are a series of projections 130 on the base of the body 124. The openings 132 are interleaved with the projections 130 and form a skirt 126 for retaining the closure body 124 on the container 112 (FIG. 7). Each projection 130 includes a retaining ridge 136 formed for securing the closure on a rim (118; FIG. 9) on the container 112. The ring 128 is frangibly connected to the skirt 126, as shown at the right side of FIG. 8 in the area of the starting tab 146. The frangibility of the connection is formed by a reduced thickness in the material 142, defining the ring 128 as a tear strip that may be removed from the base of the skirt 126.

In FIG. 9, there is shown a close-up cross sectional view of the engagement of a projecting finger 134 with the rim 118 on the container 112. The finger 134 projects from the ring 128 in an inward and upward direction. The projected end 138 of the finger 134 includes a series of ridges creating an undulating or non-uniform surface (similar to that shown in FIGS. 4-6). The rim 118 of the container 112 includes a projecting bead 120, forming an undercut surface adjacent the upper container sidewall 122. The spaced fingers 134 on the ring 128 serve to retain the closure 114 on the container 112. The fingers 134 tightly engage the bead 120 on the container rim 118. The undulating surface on the projected end 138 of the fingers 134 assists in the engagement by increasing the frictional contact and by resisting transverse movement along the underside of the bead 120. The flexibility of the ridges on the projected end 138 of each finger 134 may be controlled by varying the material, the thickness of the finger or the length of each ridge in the undulating surface. The fingers 134 may also be connected to the inner surface of the ring 128 by connecting ribs (not shown in FIG. 9). The ribs, as in FIGS. 4-6, serve to increase the stiffness of the fingers 134 by limiting flex between the fingers 134 and the ring 128.

The fingers 134 serve to provide a visual identification of engagement on the rim 118 of the container 112 and of any tampering with the engagement. Removal of the engagement by the fingers 134 from the rim is contemplated to require a bending of a finger 134. Hence, any bending of the fingers 134 away from engagement of the bead 120 would preferably result in a plastic deformation of the material forming the finger 134, which would be visible upon inspection through the space formed by the openings 132 associated with each finger 134.

As shown in FIG. 9, a shoulder 148 is provided on the base of the closure body 124, above the space 132 in the skirt (126). A shown, the shoulder surface 148 rests on the upper surface of the rim 118 of the container 112. The rim 118 is lodged between the projected end 138 of the finger 134 and the shoulder surface 148, securing the closure (114) to the rim 118. Upon removal of the ring 128, the fingers 134 are also removed from the closure 114. However, the closure 114 may be releasably secured to the rim 118 of the container 112 by means of the ridges 136 on the inside surface of the projections 130, as shown in FIG. 8.

In FIGS. 10-14, there is shown a further embodiment of a closure 214. The closure 214 includes a central body portion 224 and a surrounding skirt 226, ending in an annular ring 228. The body 224 is preferably dimensioned to extend across and cover the discharge opening of a container, such as the container 12 (referring to FIGS. 1 and 1A). As shown, the body 224 is formed as a well with a base portion 250 and an upstanding sidewall 252. The outside diameter/dimension of the sidewall 252 is contemplated to correspond to the inside diameter/dimension of a container sidewall (22) adjacent its discharge opening. The body 224 may be frictionally retained within the discharge opening on the container. The frictional contact between the body sidewall 252 and the container sidewall is contemplated to allow for removal of the body 224 from the opening when desired by the package user. A peripheral flange 254 is provided at the upper end of the body sidewall 252 and connects with the skirt 226.

The skirt portion 226 of the closure 214 extends outwardly from the flange 254 of the closure body 224. The skirt 226 includes a plurality of projections 230 that surround the upper surface of the rim (18) and the outer surface of the bead portion (20) when the closure 214 is positioned on a container. The projections 230 are spaced from one another, with the spaces 232 assisting in the formation of a tamper evident structure. The ring 228 is frangibly connected to the projections 230 and surrounds the container rim (18) when a package is assembled. The projections 230 extend along the upper sidewall (22) of a container, with the ring 228 being spaced from the sidewall. A plurality of inwardly directed fingers or tabs 234 are provided on the ring 228. The fingers 234 angle inwardly from the inside of the ring 228 and are formed to engage a bead portion (20) of the container rim (18).

Figure 10:
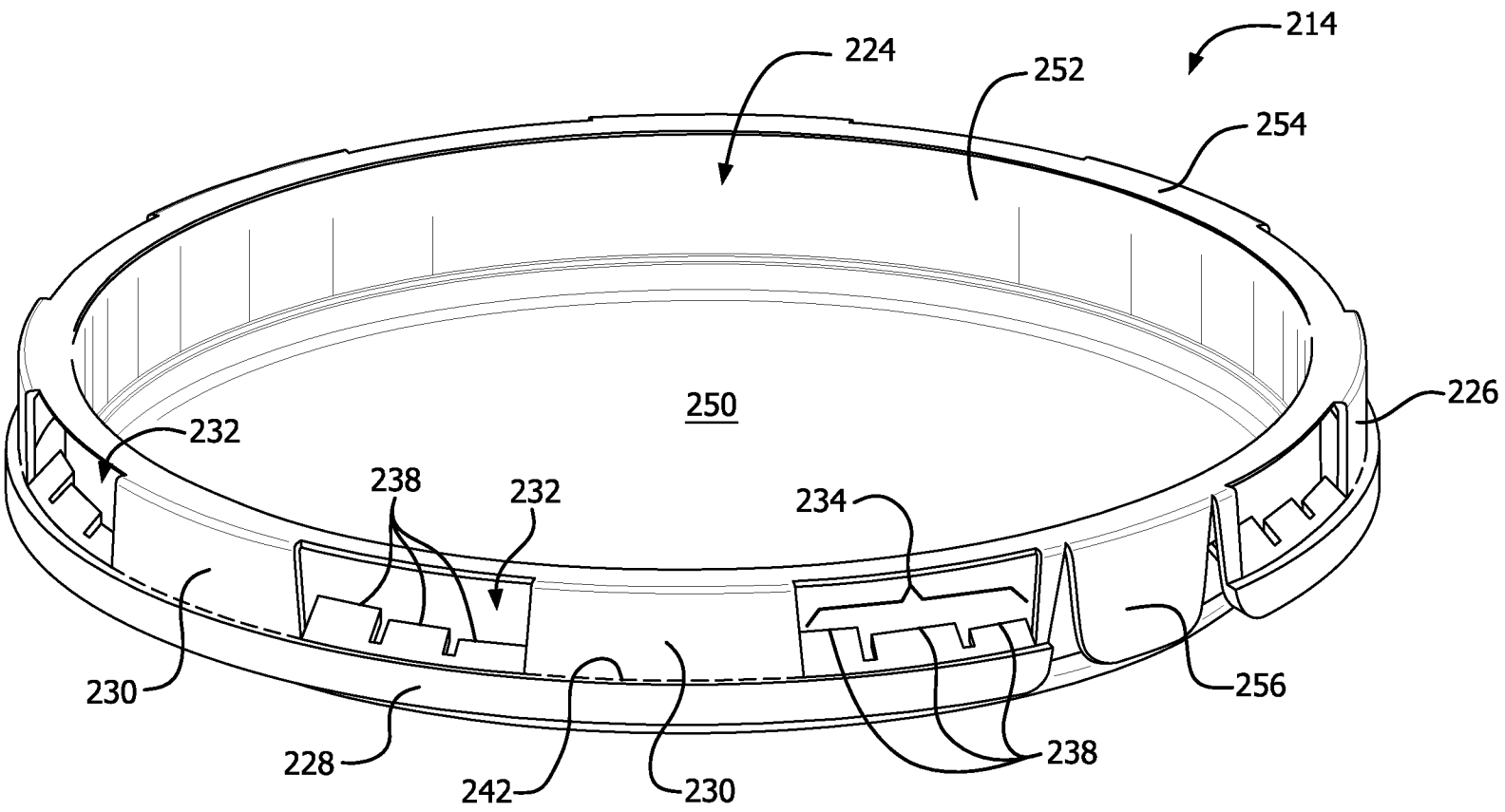
FIG. 10 shows an isometric view of a closure in a further form contemplated by the present disclosure, the closure embodiment shown for use with a container of the type shown in FIG. 1.

A frangible connection is formed between the projections 230 and the ring 228. This frangible connection is represented in FIG. 10 by a dotted line 242. The frangible connection is contemplated to be formed by a reduced thickness within the wall of the closure 214. The closure 214 is preferably formed from injection molded plastic having sufficient properties for the line of reduced thickness to form a tear line for removal of the ring 228. After removal of the ring 228, the projections 230 remain in place and form a retaining means for the closure 214 to releasably seal a container discharge opening. The frangible connection may be located at other places on the skirt, and may be located adjacent the flange 254. As shown in FIG. 10, a gap is provided in the ring 228 and an opening tab 256 is provided. The opening tab 256 forms a projecting structure that is separate from the removable ring 228 and (as shown) is separate from the projections 230.

The ring 228 is disconnected from the projections 230 and the inner fingers 234 are also removed from the closure skirt 226. The ring 228 is completely removed from the outer periphery of the skirt 226, leaving the opening tab 256 and the projections 230.

Figure 11:
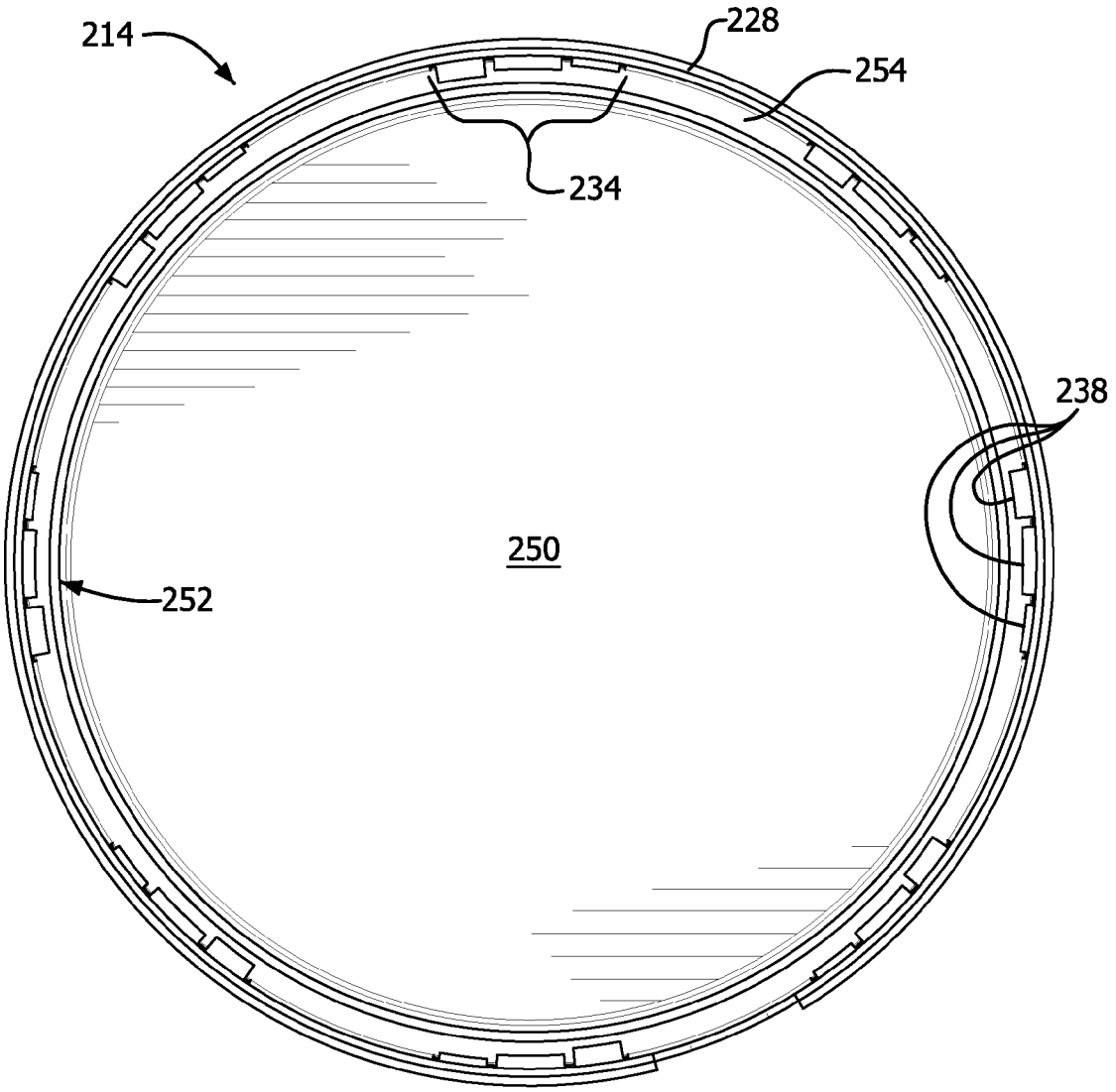
FIG. 11 shows a top plan view of the closure embodiment shown in FIG. 10.
Figure 12:
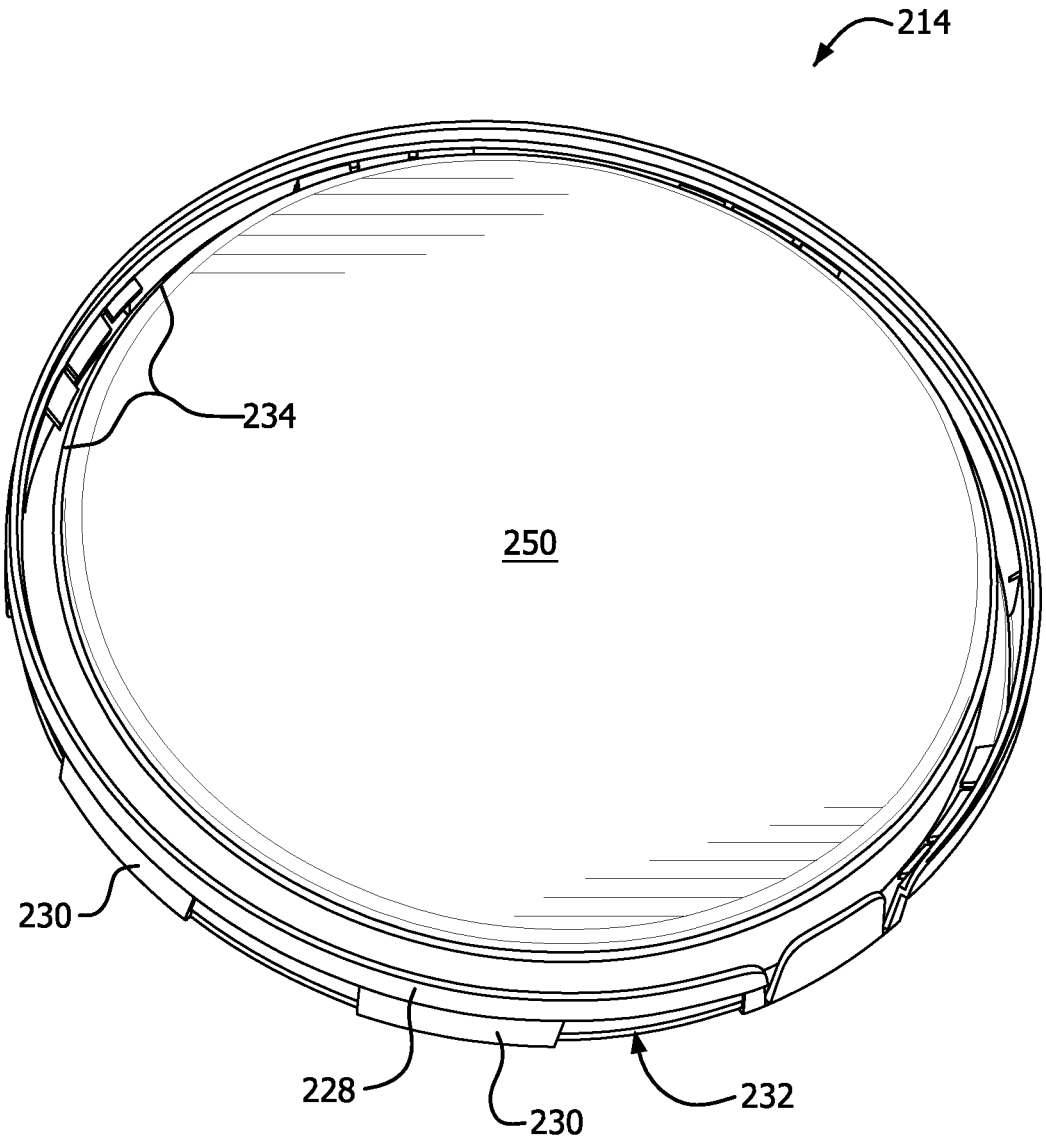
FIG. 12 shows a bottom isometric view of the closure embodiment of FIGS. 10 and 11.
Figure 14:
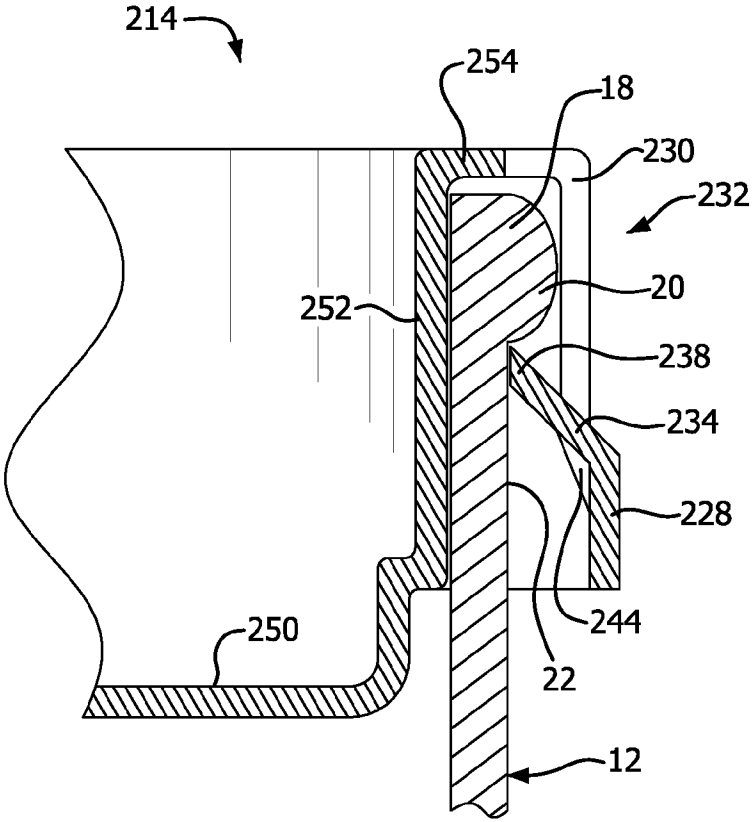
FIG. 14 shows an alternate view of the portion of the closure of FIG. 13, with the container rim engaged by the closure.

The internal engagement of the fingers 234 with the rim 18 of a container 12 is illustrated in cross section in FIG. 14. In FIGS. 10-12, the fingers 234 comprise multiple sections that form an undulating or varied surface on the projected end 238. The varied surface of the projecting end 238 of each finger 234 is provided to create a better grip between the fingers 234 and the bead of the container rim. This enhanced grip is useful both in rolled rims formed from the sidewall of the container and metal beads that are crimped onto the rim of the container opening. In addition, as shown, a gap or separation is provided between the sections of the fingers 234. The spacing allows the sections of the fingers to flex in the engagement with bead on the rim of the container.

Figure 13:
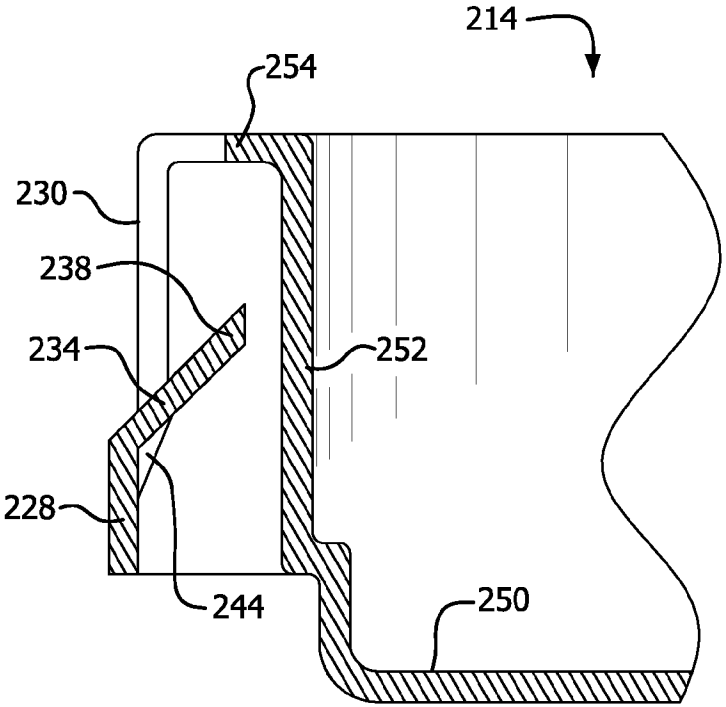
FIG. 13 shows an enlarged cross sectional view of a portion of the closure of FIGS. 10-12.

The cross sections of FIGS. 13 and 14 are taken through the skirt 226 at the location of an opening or space 232. Hence, the surface of the projected ends 238 of the fingers 234 is shown, with the adjacent projection 230 positioned behind the finger 234 and the ring 228. The undulating or varied surface of the ends 238 of the fingers 234 is directed at an upward angle and inwardly towards the outside surface of the sidewall 252. A connecting rib 244 is provided on the underside of the finger 234, forming a connection between the finger 234 and the inside of the ring portion 228. The container rim 18 is inserted into the open area bounded by the outside surface of the sidewall 252, the upper flange 254 (where provided) and the adjacent projection 230. The outwardly projecting bead 20 on the container rim is engaged by at least one of the projected ends 238 of the finger 234, preferably at the intersection of the bead 20 and the upper sidewall 22 of the container 12. The inside surface of the container sidewall 22 is in contact with the outside surface of the body sidewall 252 of the closure 14.

The fingers 234 are visible through the spaces 232 between adjacent projections 230 to provide for inspection of the engagement between the fingers 234 and the container bead 20. Separation of the fingers 234 around the container rim 18 is required to remove the closure 214 from the container 12. Hence, any visible misalignment or deformation of one or more of the projected ends 238 of the fingers 234 provides an indication of tampering. The connection ribs 244 may assist in the visual identification of tampering. The ribs 244 make it more difficult for the fingers 234 to be deformed. Hence, any bending of the fingers 234 away from the container rim 18 will preferably result in a plastic deformation of the material that is visible upon inspection.

The skirt 226 is removed from the body 224 of the closure by a tearing along the line 242. The engagement of the body 224 of the closure 214 with the upper sidewall 22 and rim 18 of the container 12 is then created by the outside surface of the sidewall 252 and the wrapping of the projections 230 around the rim 18. If the skirt as a whole is removed from the body of the closure, the frictional engagement of the sidewall 252 and the contact of the flange 254 positions the closure 214 on the discharge opening. A lifting force on the tab 256 may be used to overcome the friction between the sidewall 252 and the container so as to remove the closure from the container.

In manufacturing the closure, an injection molding process is preferred. As a result of interleaving the projections and spaces and the alignment of the fingers in the spaces, mold part access is provided from both above and below the closure body. Preferably, no vertical overlap of the parts is provided. This type structure may be formed using a two part mold, without the need for moving mold parts. The two mold halves can be separated from above and below the part. Any ridge structures (36, 136) on the inside surface of the projections (e.g., 30 and 130) are contemplated to be limited in the amount of inward projection and are formable using normal molding techniques.

The present invention has been described and illustrated with respect to one or more exemplary embodiments. It should be understood by those skilled in the art from the foregoing that various other changes, omissions and additions may be made therein, without departing from the spirit and scope of the present invention, with the scope of the invention being described by the foregoing claims.

What is claimed is:

1. A closure for use in covering container discharge, the discharge surrounded by a peripheral rim having an outwardly projecting peripheral bead, the closure comprising:

a body adapted to cover the discharge;

a plurality of projecting portions extending from a periphery of the body, the projecting portions spaced from one another around the periphery, each projecting portion adapted to engage a portion of the container rim and a corresponding portion of the bead;

a ring connected to the plurality of projecting portions, the ring adapted to surround container rim and being spaced therefrom; and a plurality of retaining fingers, the fingers spaced from one another and interleaved within the spacing between adjacent projecting portions, the fingers projecting inwardly from the ring and each forming a projected end, each of the projected ends of the fingers having an end surface formed thereon, the end surface of the projected end of each of the fingers having a circumferential width and adapted to engage the bead associated with the container rim, and a plurality of ridges formed on the end surface of the projected end of each finger, each of the ridges within the plurality extending along the circumferential width of the projected end of the finger, and the plurality of ridges forming an undulating surface on the projected end of each of the fingers with the direction of the undulating surface being oblique to the direction of the extension of the ridges, wherein the engagement of the fingers with the bead is visible through the spacing between the projecting portions, and wherein the fingers are removed along with the ring upon a frangible disconnection of the ring from the projecting portions.

2. A closure as in claim 1 wherein the projecting portions further comprise an inwardly facing surface, said surfaces each having an inwardly projecting ridge for engaging the bead portion of the container rim.

3. A closure as in claim 1 wherein the projecting portions are curved and are formed for wrapping around the container rim.

4. A closure as in claim 1 wherein the body forms a substantially planer surface and overlaps at least a portion of the container rim.

5. A closure as in claim 1 wherein the plurality of ridges are aligned perpendicular to a radial line formed by the closure.

6. A closure as in claim 1 wherein the ring is frangibly connected to the projections.

7. A package comprising a container having a rim surrounding a container discharge, the container discharge providing access to contents of the container, the container rim having a projecting peripheral bead; and a closure removably covering container opening and engaging the container rim, the closure comprising a body portion dimensioned to cover the container discharge, a rim engagement structure formed by a plurality of projecting portions, the projecting portions spaced from one another and each formed to engage the rim of the container to removably retain the closure in a covering relation with the container discharge, a ring frangibly affixed to projecting portions, the ring adapted to substantially encircle the rim of said container, and a plurality of tamper-evident fingers projecting from an inside surface of the ring, each finger angled inwardly and including a projected end having a width dimension positioned transverse to a radial line formed from a center of the body, the plurality of fingers adapted for engagement with the bead portion, said fingers spaced from one another and each positioned within the space defined between adjacent projecting portions, the container rim engagement of the fingers being visible through the space defined between adjacent projecting portions to form a tamper-evident assembly, and the projected ends of each of the fingers having an undulating end surface formed by a plurality of ridges aligned with and extending along the width dimension of the projected end of the finger and the undulations of the end surface being transverse to the direction of extension of the ridges, the undulating end surface of the projected end of each of the fingers adapted to engage the peripheral bead on the container rim upon securing the closure on the container rim.

8. A package as in claim 7 wherein the projecting portions further comprise an inwardly facing surface, said surfaces each having an inwardly projecting ridge for engaging the bead portion of the container rim.

9. A package as in claim 7 wherein the projecting portions are curved and are formed for wrapping around the container rim.

* * * * *